US010837623B1

(12) United States Patent
Tsao

(10) Patent No.: US 10,837,623 B1
(45) Date of Patent: Nov. 17, 2020

(54) LIGHT HAVING LIGHT EMITTING DIRECTION ADJUSTABLE FROM INNER SIDE OF LIGHT CASE

(71) Applicant: ARTLED TECHNOLOGY CORP., Taoyuan (TW)

(72) Inventor: Chia-Tsung Tsao, Taipei (TW)

(73) Assignee: ARTLED TECHNOLOGY CORP., Taoyuan (TW)

( * ) Notice: Subject to any disclaimer, the term of this patent is extended or adjusted under 35 U.S.C. 154(b) by 0 days.

(21) Appl. No.: 16/791,868

(22) Filed: Feb. 14, 2020

(51) Int. Cl.
*F21V 14/02* (2006.01)
*F21V 21/30* (2006.01)
*F21V 19/02* (2006.01)

(52) U.S. Cl.
CPC ..... *F21V 14/02* (2013.01); *F21V 19/02* (2013.01); *F21V 21/30* (2013.01)

(58) Field of Classification Search
CPC ..... F21V 14/02; F21V 19/02; F21V 14/026; F21S 4/28
See application file for complete search history.

(56) References Cited

U.S. PATENT DOCUMENTS 7,207,696 B1 * 4/2007 Lin ..... F21V 14/02 362/232
7,866,847 B2 * 1/2011 Zheng ..... F21V 29/763 362/249.03

* cited by examiner

*Primary Examiner* — Robert J May
(74) *Attorney, Agent, or Firm* — Marshall A. Lerner; Bradford E. Mattes; Kleinberg & Lerner, LLP.

(57) ABSTRACT

A light comprises a light case, an illuminating assembly, and an adjusting assembly. The light case has a first side segment. The illuminating assembly is mounted inside the light case, is pivoted on the first side segment, and has a base having a pivoting segment pivoted on the first side segment. The at least one lighting unit is mounted on the base. The adjusting assembly is mounted on the first side segment of the light case, is connected to the base, extends outside the light case, and is capable of tilting the illuminating assembly. Thus, a user is allowed to adjust a light emitting direction of the illuminating assembly, which is mounted inside the light case, via the adjusting assembly, which extends outside the light case, without tilting the light case.

11 Claims, 12 Drawing Sheets

LIGHT HAVING LIGHT EMITTING DIRECTION ADJUSTABLE FROM INNER SIDE OF LIGHT CASE

BACKGROUND OF THE INVENTION

1. Field of the Invention

The present invention relates to a light, especially to a light that facilitates users to adjust a light emitting direction from an inner side of a light case of the light.

2. Description of the Prior Arts

With reference to FIG. 12, a conventional light with adjustable light emitting direction has a bracket 61, a pivoting base 62, and a light case 63. The bracket 61 is adapted to be fixed onto a mounting surface (such as a wall). The pivoting base 62 is tiltably mounted on the bracket 61. The light case 63 is mounted securely on the pivoting base 62. An illuminating assembly is mounted securely inside the light case 63 and is capable of emitting light toward an outerside of the light case 63. By this, a light emitting direction of the illuminating assembly can be adjusted by tilting the pivoting base 62 and the light case 63 relative to the bracket 61.

However, because the light emitting direction of the illuminating assembly is adjusted by tilting the pivoting base 62 and the light case 63 relative to the bracket 61, when mounting the conventional light, an appropriate space must be reserved around the conventional light in order to ensure the pivoting base 62 and the light case 63 will be tiltable after installation. Furthermore, after the pivoting base 62 and the light case 63 are tilted, an appearance of the conventional light is changed, which affects the visual impression built together by the conventional light and the surrounding environment.

Therefore, the conventional light needs to be improved.

To overcome the shortcomings, the present invention provides a light that facilitates users to adjust a light emitting direction from inside of a light case of the light to mitigate or obviate the aforementioned problems.

SUMMARY OF TUE INVENTION

The main objective of the present invention is to provide a light that facilitates users to adjust a light emitting direction from inside of a light case of the light without tilting the light case.

The light has a light case, an illuminating assembly, and an adjusting assembly. The light case is hollow and has a first side segment and a second side segment respectively located on two opposite sides of the light case. The illuminating assembly is mounted inside the light case, is pivotably connected to the first side segment and the second side segment of the light case, and has a base and at least one lighting unit. The base has two pivoting segments respectively located on two opposite ends of the base and respectively pivotably connected to the first side segment and the second side segment of the light case. The at least one lighting unit is mounted on the base. The adjusting assembly is mounted on the first side segment of the light case, is connected to the base, extends outside the light case, and is adapted to tilt the illuminating assembly.

By the structure as mentioned above, a user is allowed to adjust a light emitting direction and a light emitting angle of the illuminating assembly, which is mounted inside the light case, via the adjusting assembly, which extends outside the light case, without tilting the light case. Therefore, no extra space is needed to be reserved before mounting the light in the present invention; thereby making the light applicable in much more positions.

Furthermore, because the light case does not need to be tilted luring adjustment of the light emitting direction of the illuminating assembly, the appearance of the light remains the same as its initial design, thereby avoiding affecting the visual impression built together by the light and the surrounding environment.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
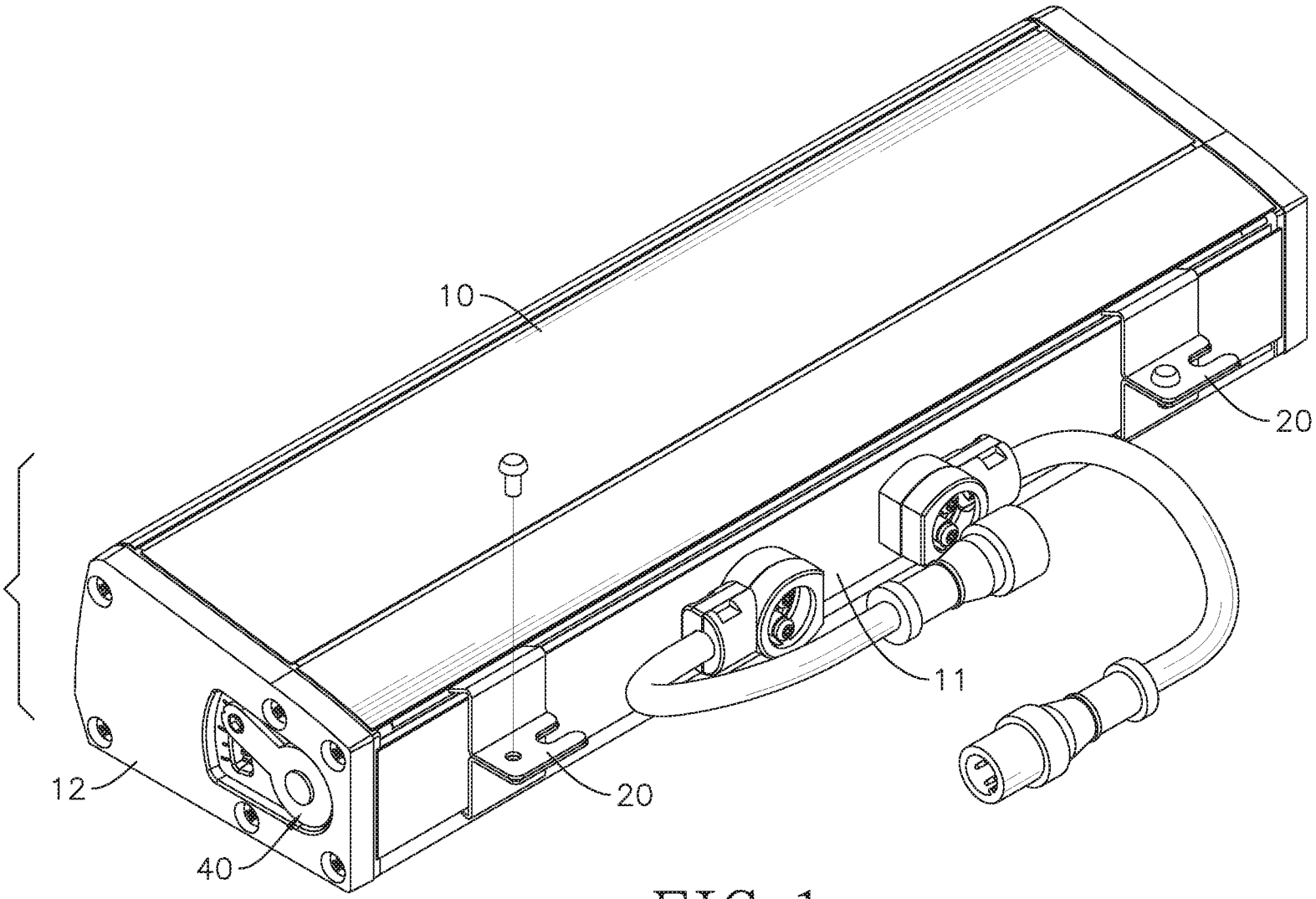
FIG. 1 is a perspective view of a first preferred embodiment of a light in accordance with the present invention.
Figure 2:
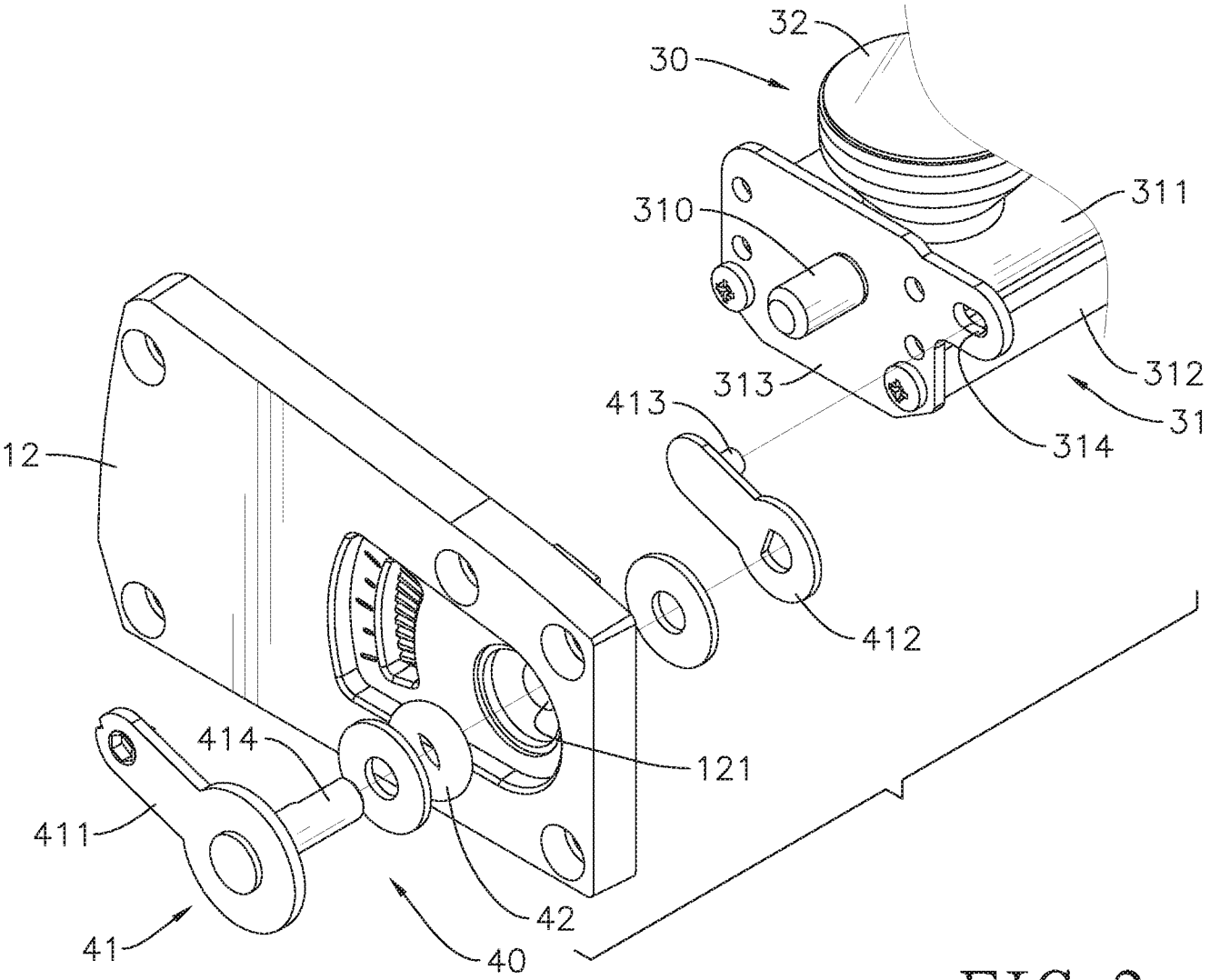
FIG. 2 is a partial exploded view of the first preferred embodiment of the light in FIG. 1.
Figure 3:
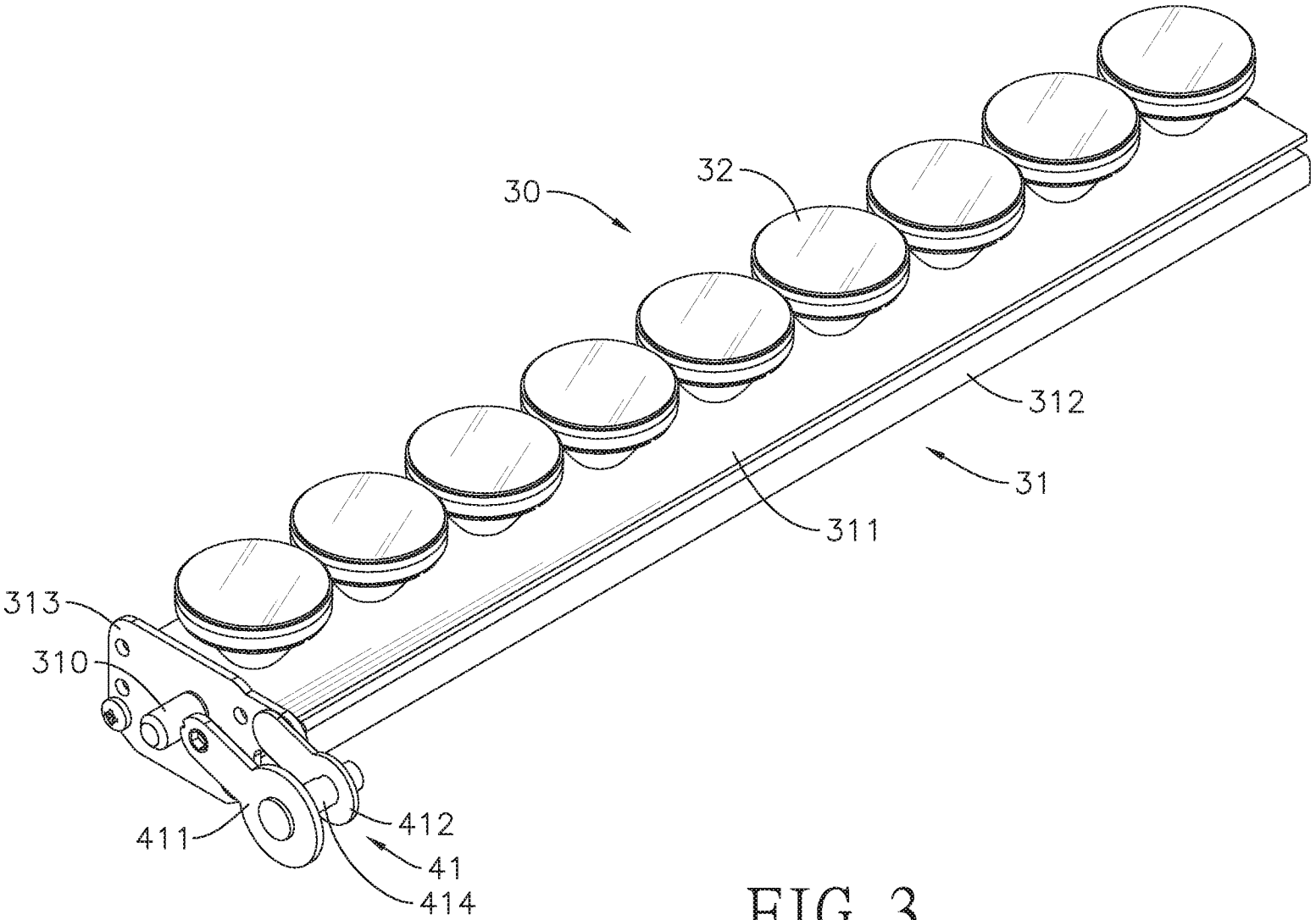
FIG. 3 is a perspective view of the first preferred embodiment of the light in FIG. 1, showing the illuminating assembly.

With reference to FIGS. 1 to 3, a light, which has a light emitting direction adjustable from an inner side of a light case of the light, in accordance with the present invention comprises a light case 10, at least one bracket 20, an illuminating assembly 30, and an adjusting assembly 40.

The light case 10 is hollow, has a front side segment and a back segment 11 respectively located on two opposite sides of the light case 10, and has a first side segment 12 and a second side segment respectively located on the other two opposite sides of the light case 10. Specifically, in any preferred embodiment, the first side segment 12 and the second side segment can be two detachable side covers.

The at least one bracket 20 is mounted securely on the back segment 11 of the light case 10 and is adapted to be mounted on a mounting surface (such as a wall), thereby mounting the light onto the said mounting surface.

Figure 4:
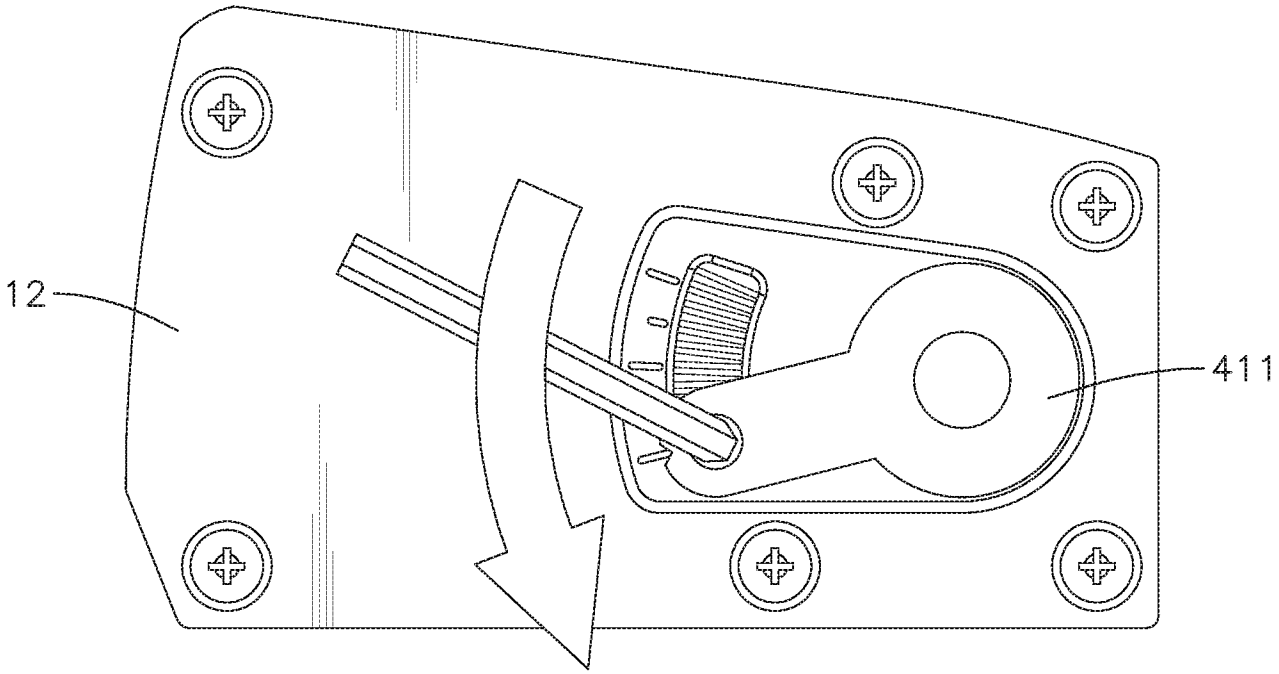
FIG. 4 is a side view of the first preferred embodiment of the light in FIG. 1, showing the operation of the adjusting assembly outside the light case.
Figure 5:
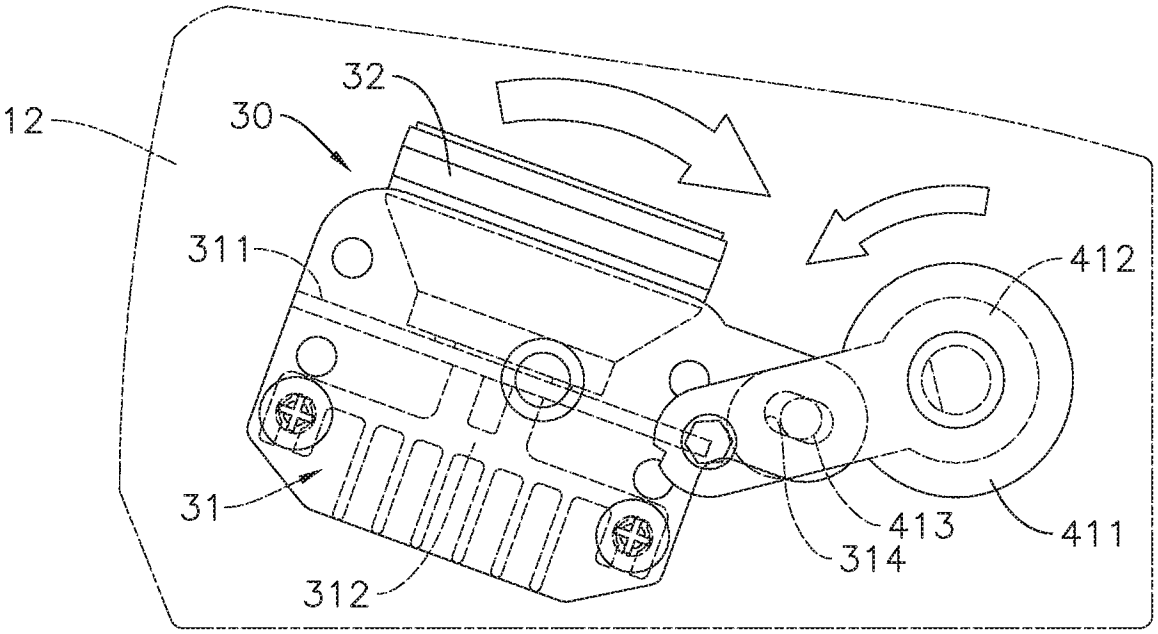
FIG. 5 is a side view of the first preferred embodiment of the light in FIG. 1, showing the operation of the adjusting assembly and the illuminating assembly inside the light case.

With reference to FIGS. 4 and 5, the illuminating assembly 30 is mounted inside the light case 10 and is pivotably connected to the first side segment 12 and the second side segment of the light case 10, and therefore the illuminating assembly 30 is capable of tilting forward or backward toward the front side segment or the back segment 11 of the light case 10. The illuminating assembly 30 has a base 31 and at least one lighting unit 32.

The base 31 has two pivoting segments 310 respectively located on two opposite ends of the base 31 and respectively pivotably connected to the first side segment 12 and the second side segment of the light case 10, and therefore the base 31 is capable of tilting forward or backward relative to the light case 10. The at least one lighting unit 32 is mounted on the base 31 and is capable of emitting light toward outside of the light case 10.

Specifically, the base 31 has a circuit board 311, a heat sink 312, and a side panel 313. The at least one lighting unit 32 is mounted on the circuit board 311. The heat sink. 312 is mounted on a bottom surface of the circuit board 311 for dissipating heat generated by the circuit board 311 and the lighting unit 32. The side panel 313 is securely mounted on an end of the circuit board 311. One of the pivoting segments 310 is mounted on the side panel 313.

With reference to FIGS. 2 to 5, the adjusting assembly 40 is mounted on the first side segment 12 of the light case 10, is connected to the base 31, extends outside the light case 10, and is adapted to tilt the illuminating assembly 30. Therefore, a user is allowed to tilt the illuminating assembly 30 via the adjusting assembly 40 to adjust a light emitting direction and a light emitting angle of the illuminating assembly 30.

Specifically, the first segment 12 of the light case 10 has a through hole 121. The adjusting assembly 40 has a driving unit 41 and a water blocking gasket 42. The driving unit 41 is mounted through the through hole 121 of the first side segment 12 of the light case 10, and is connected to the side panel 313 of the base 31. By this, when the user tilts the driving unit 41, the driving unit 41 tilts the illuminating assembly 30. The water blocking gasket 42 is mounted around the driving unit 41 and is clamped between the driving unit 41 and an edge of the through hole 121. The water blocking gasket 42 is capable of blocking moisture and dust from entering the light case 10 through the through hole 121, and is also capable of providing friction to position the driving unit 41 in a particular angular position.

With reference to FIGS. 2 and 3, in a first preferred embodiment, the side panel 313 of the base 31 of the illuminating assembly 30 further has an elongated hole 314. The driving unit 41 of the adjusting assembly 40 has an outer driving sheet 411, an inner transmission sheet 412, and a shaft 414. The outer driving sheet 411 is located outside the light case 10 and corresponds in position to the first side segment 12 of the light case 10. The inner transmission sheet 412 is located inside the light case 10 and is located between the side panel 313 and the first side segment 12 of the light case 10. The inner transmission sheet 412 has a linkage protrusion 413 mounted on a side surface, which faces to the side panel 313, of the inner transmission sheet 412. The linkage protrusion 413 protrudes into the elongated hole 314 of the side panel 313. The shaft 414 is mounted through the through hole 121 of the first side segment 12 of the light case 10. Two ends of the shaft 414 are respectively securely mounted on the outer driving sheet 411 and the inner transmission sheet 412. The shaft 414 and an axis connecting the pivoting segment 310 and the first side segment 12 are non-coaxial. The water blocking gasket 42 is mounted around the shaft 414 and is clamped between the edge of the through hole 121 and the shaft 414.

By this, with reference to FIG. 5, when the user tilts the outer driving sheet 411 from outside of the light case 10, the user indirectly tilts the base 31 of the illuminating assembly 30 forward or backward relative to the light case 10 via the shaft 414 and the inner transmission sheet 412.

Figure 6:
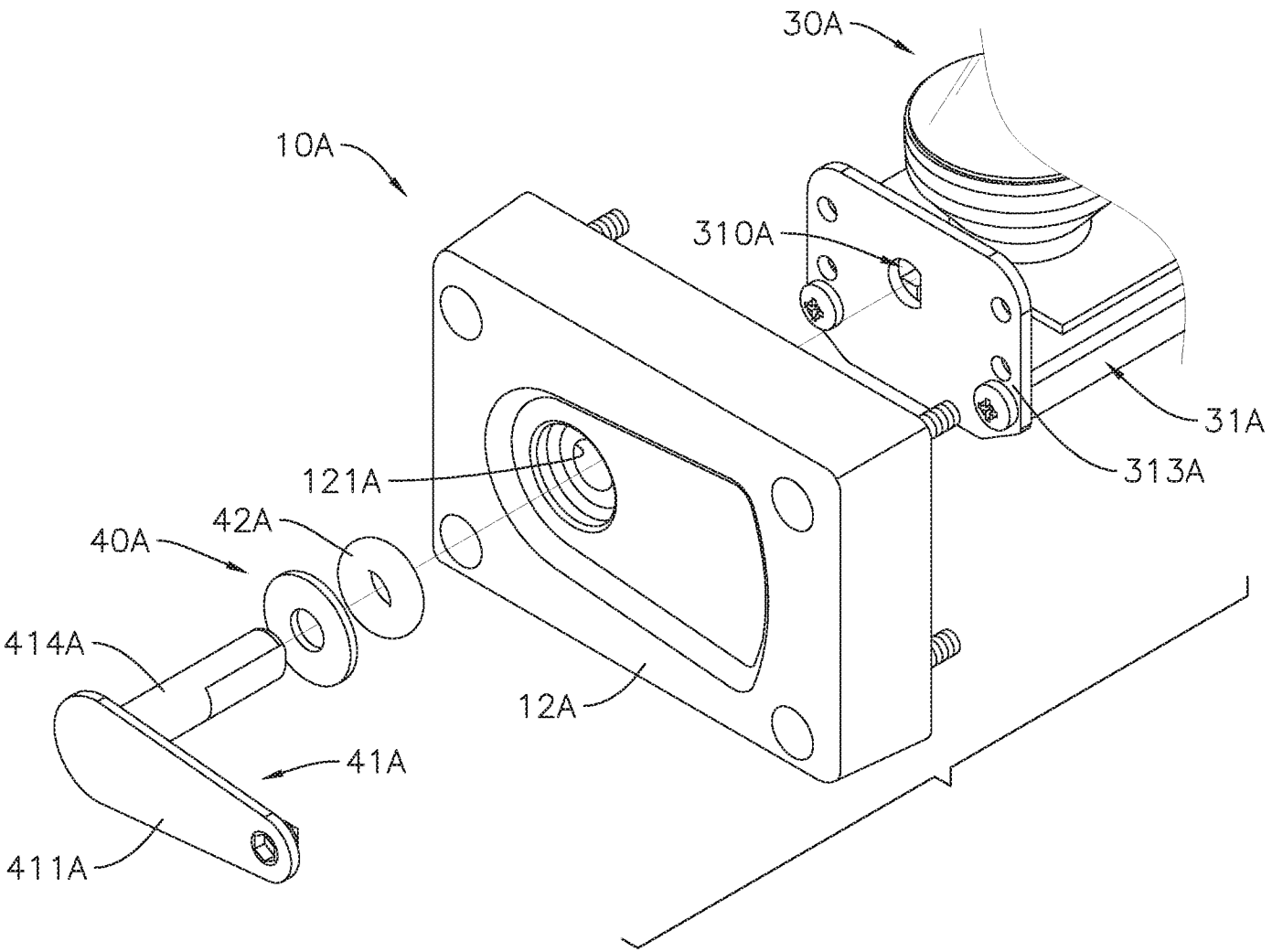
FIG. 6 is a partial exploded view of a second preferred embodiment of the light in accordance with the present invention.
Figure 7:
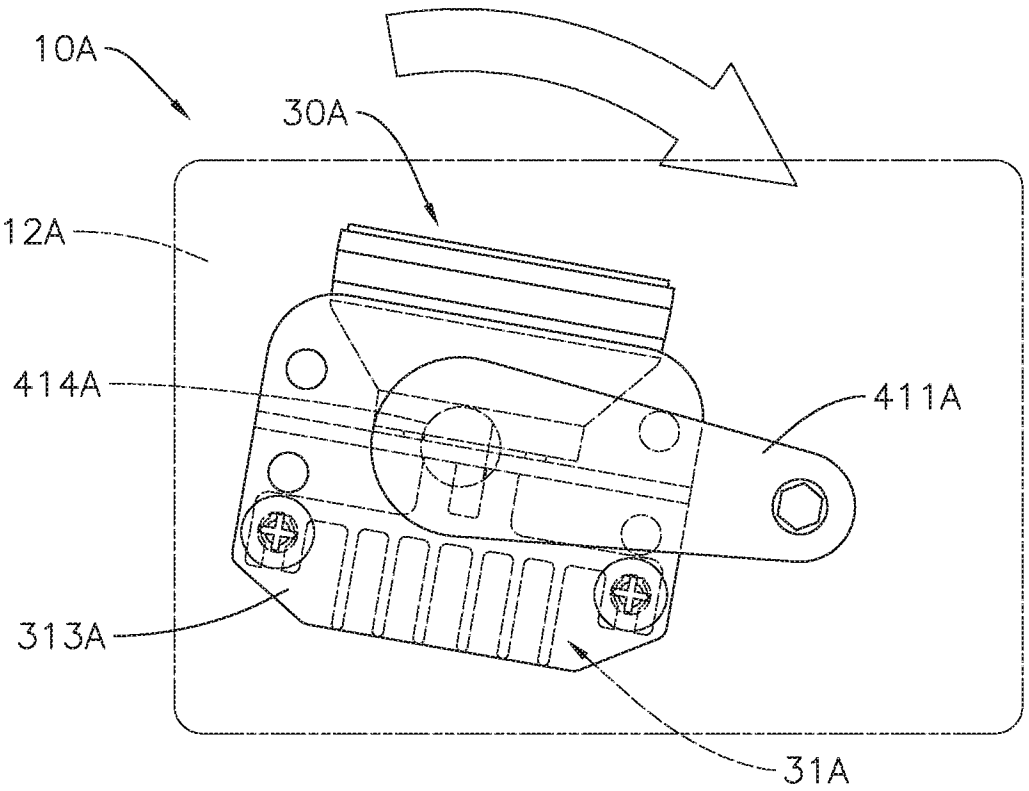
FIG. 7 is a side view of the second preferred embodiment of the light in FIG. 6, showing the operation of the adjusting assembly and the illuminating assembly.

With further reference to FIGS. 6 and 7, in a second preferred embodiment, the driving unit 41A of the adjusting assembly 40A has an outer driving sheet 411A and a shaft 414A. The outer driving sheet 411A is located outside the light case 10A and corresponds in position to the first side segment 12A of the light case 10A. The shaft 414A is mounted through the through hole 121A of the first side segment 12A of the light case 10A, Two ends of the shaft 414A are respectively mounted on the outer driving sheet 411A and the side panel 313A of the base 31A of the illuminating assembly 30A. The shaft 414A and the pivoting segment 310A of the base 31A of the illuminating assembly 30A are co-axial. The water blocking gasket 42A is mounted around the shaft 414A and is clamped between the edge of the through hole 121A and the shaft 414A.

By this, with reference to FIG. 7, the user is allowed to tilt the base 31A of the illuminating assembly 30A forward or backward relative to the light case 10A via only the shaft 414A by tilting the outer driving sheet 411A from outside of the light case 10A.

Figure 8:
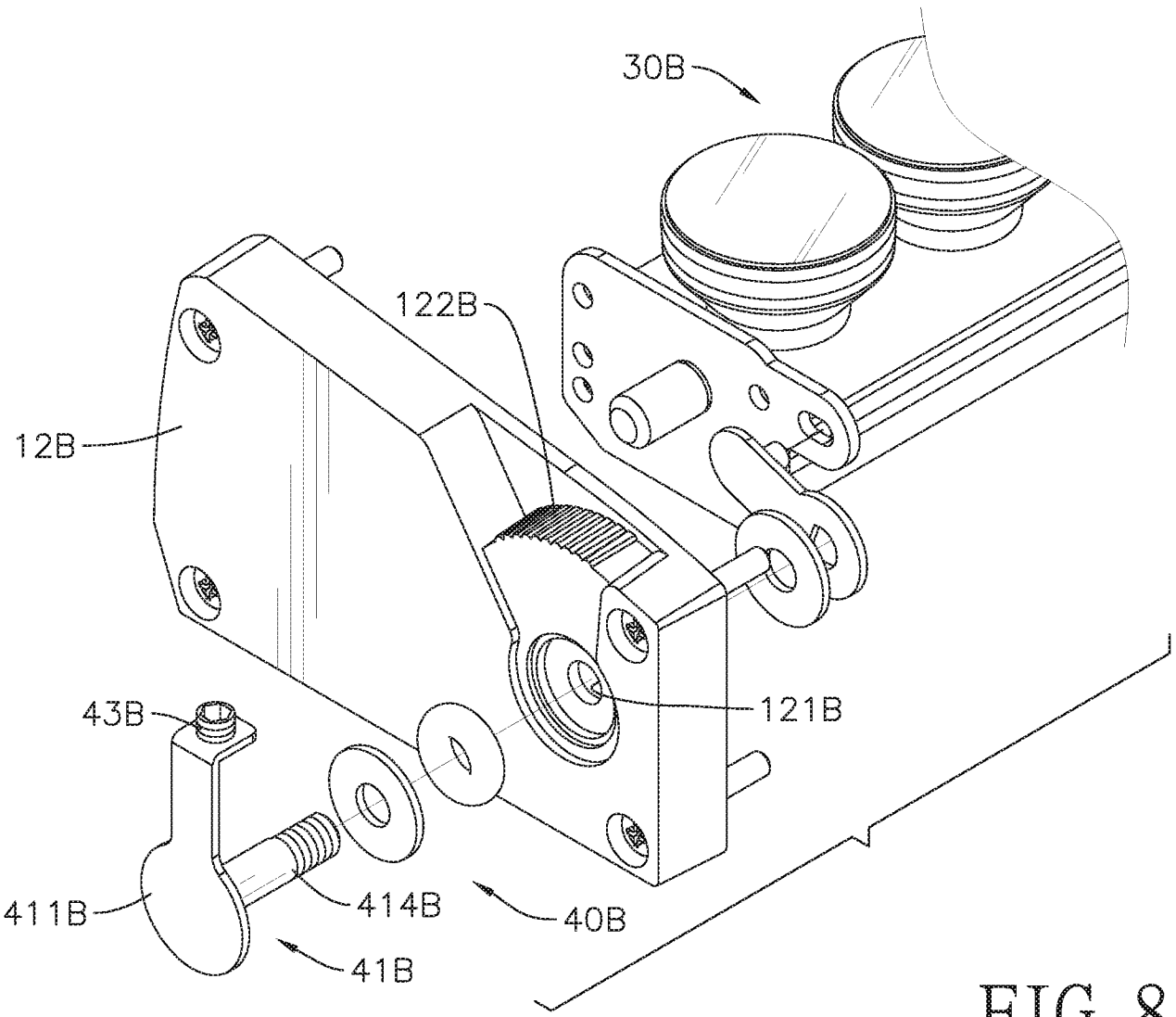
FIG. 8 is a partial exploded view of a third preferred embodiment of the light in accordance with the present invention.
Figure 9:
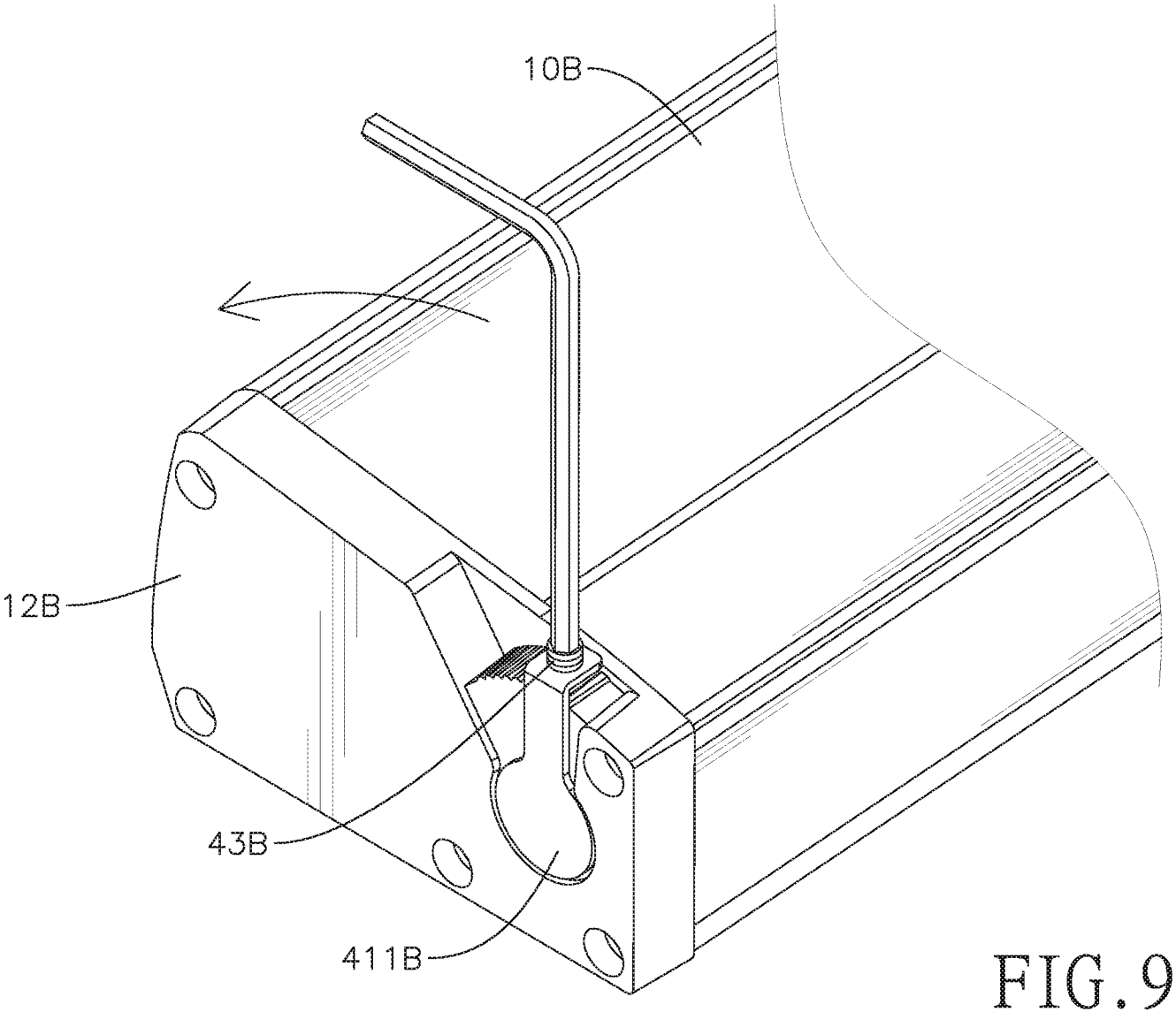
FIG. 9 is a partial enlarged perspective view of the third preferred embodiment of the light in FIG. 8, showing the adjustment.

With further reference to FIGS. 8 and 9, in a third preferred embodiment, the connecting structure between the adjusting assembly 40B and the illuminating assembly 30B is basically the same as that in the first preferred embodiment, and the few differences between the two embodiments are as follows.

In a third preferred embodiment, the first segment 12B further has an anti-slip arced surface 122B being coaxial with the through hole 121B of the first side segment 12B. An end of the outer driving sheet 411B of the driving unit 41B of the adjusting assembly 40B is mounted securely on the shaft 414B, and the other end of the outer driving sheet 411B corresponds in position to the anti-slip arced surface 122B of the first side segment 12B of the light case 10B. The adjusting assembly 401B further has a stop screw 43B mounted through the outer driving sheet 411B of the driving unit 41B and threaded with the outer driving sheet 411B, and therefore the stop screw 43B selectively abuts the anti-slip arced surface 122B of the first side segment 12B of the light case 10B.

The user is allowed to move the stop screw 43B along the axial direction toward or away from the side segment 12B of the light case 10B by rotating the stop screw 43B. When the stop screw 43B abuts the anti-slip arced surface 122B of the side segment 12B of the light case 10B, the stop screw 43B fixes the relative angular position between the driving unit 41B and the illuminating assembly 30B.

Figure 10:
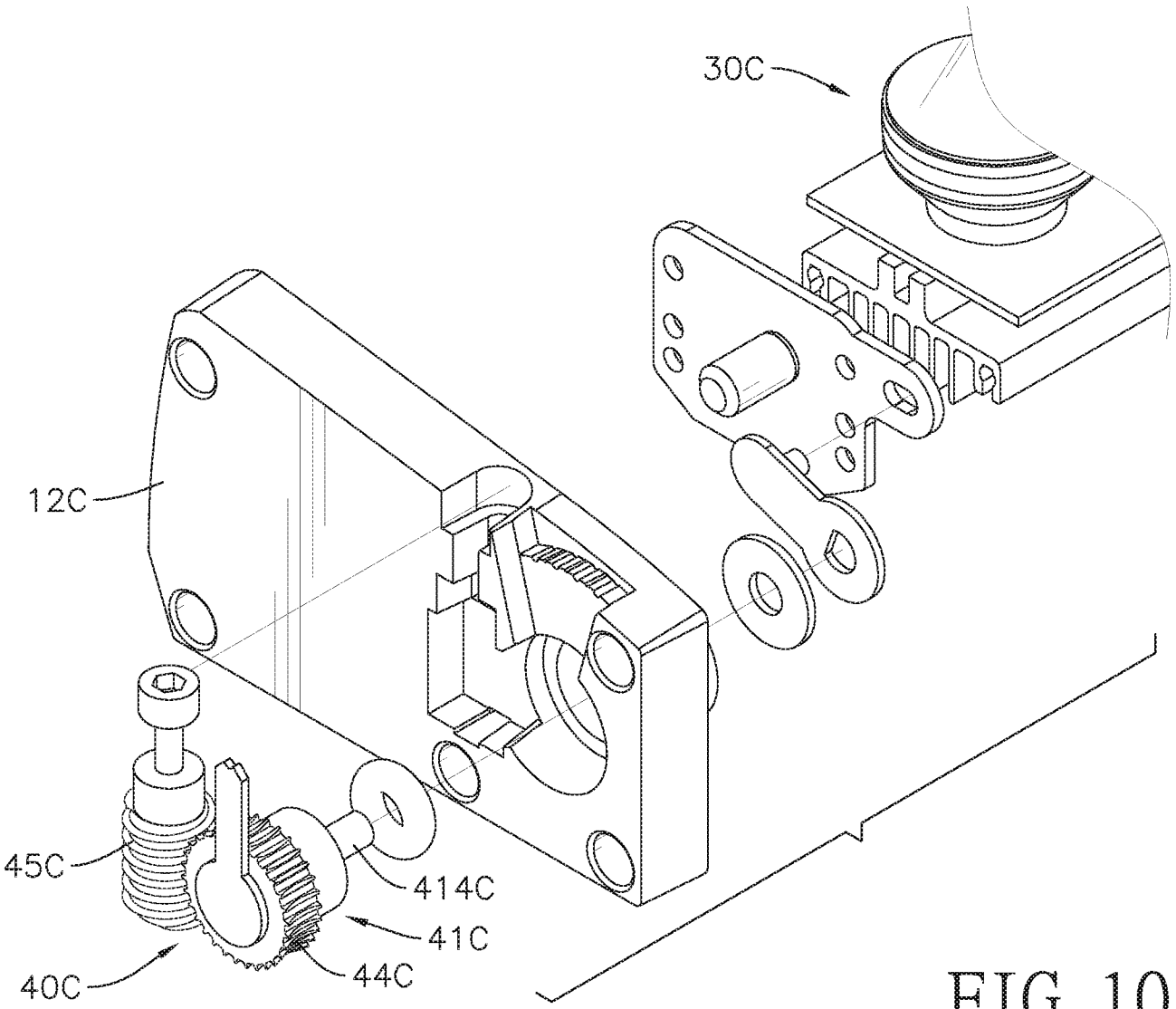
FIG. 10 is a partial exploded view of a fourth preferred embodiment of the light in accordance with the present invention.
Figure 11:
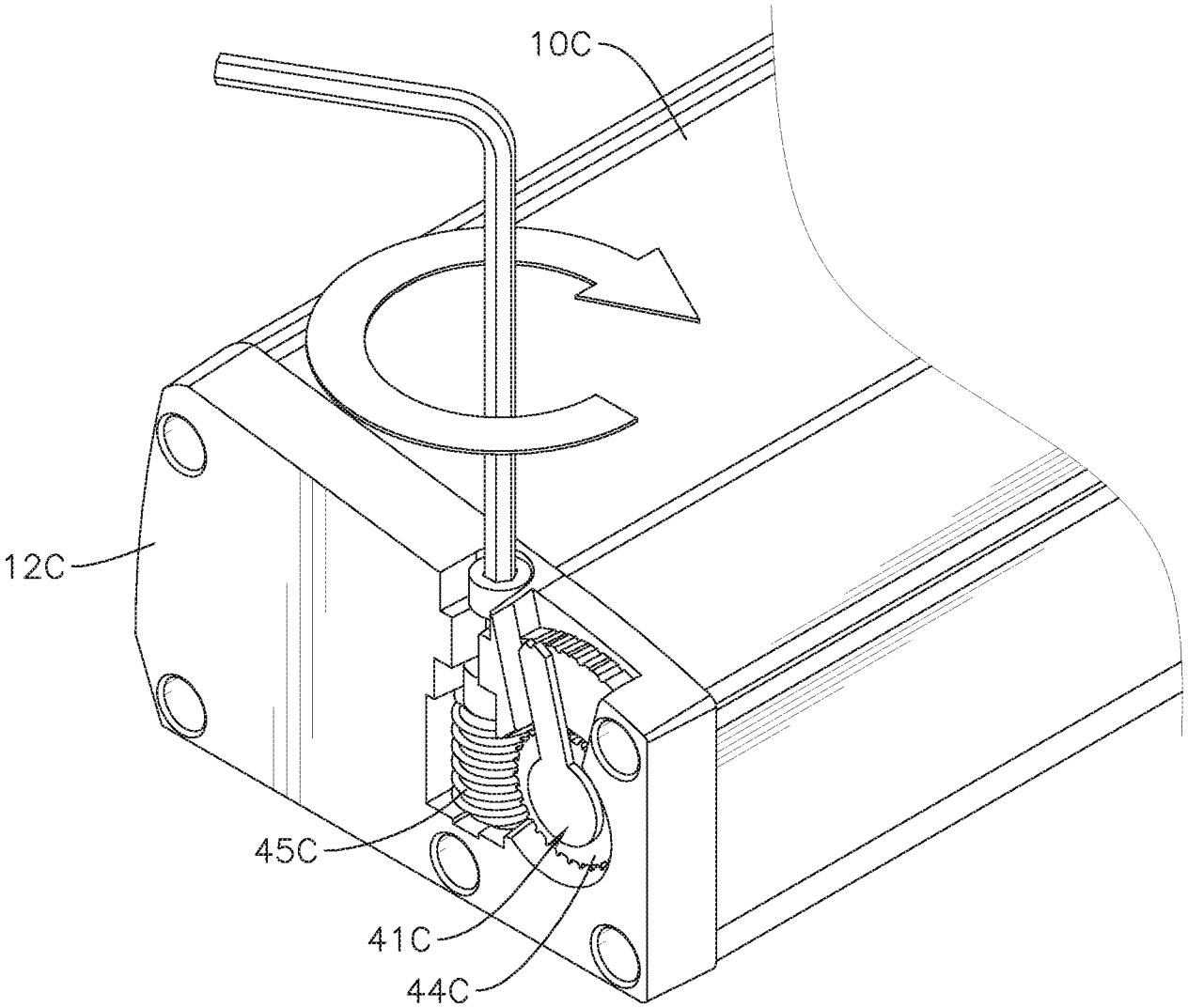
FIG. 11 is a partial enlarged view of the fourth preferred embodiment of the light in FIG. 10, showing the adjustment.
Figure 12:
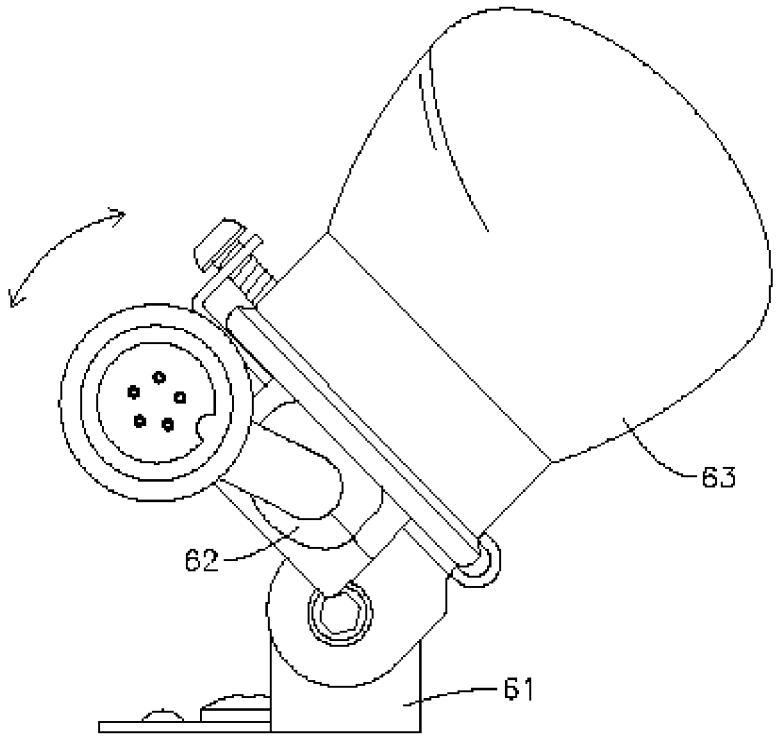
FIG. 12 PRIOR ART
FIG. 12 is a side view of a conventional light.

With further reference to FIGS. 10 and 11, in a fourth preferred embodiment, the connecting structure between the adjusting assembly 40C and the illuminating assembly 30C is basically the same as that in the first preferred embodiment, and the few differences between the two embodiments are as follows.

In the fourth preferred embodiment, the adjusting assembly 40C further has a worm gear 44C and a worm screw 45C. The worm gear 44C is securely mounted around the shaft 414C of the driving unit 41C and is located outside the light case 10C. The worm screw 45C is rotatably mounted on the first side segment 12C of the light case 10C and engages with the worm gear 44C.

By this, the user is allowed to sequentially drive the worm gear 44C, the driving unit 41C, and the illuminating assembly 30C by rotating the worm screw 45C to adjust the light emitting direction and the light emitting angle of the illuminating assembly 30C.

The advantage of the light in accordance with the present invention is that the user is allowed to adjust the light emitting direction and the light emitting angle of the illuminating assembly 30, 30A, 30B, or 30C, which is mounted inside the light case 10, 10A, 10B, or 10C, via the adjusting assembly 40, 40A, 40B, or 40C, which extends outside the light case 10, 10A, 10B, or 10C, without tilting the light case 10, 10A, 10B, or 10C. Therefore, no extra space needs to be reserved before mounting the light, thereby making the light being applicable in much more positions.

Furthermore, because the light case 10, 10A, 10B, or 10C does not need to be tilted during adjustment of the light emitting direction of the illuminating assembly 30, 30A, 30B, or 30C, the appearance of the light remains the same as its initial design, thereby avoiding affecting the visual impression built together by the light and the surrounding environment.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A light comprising:

a light case being hollow and having a first side segment and a second side segment respectively located on two opposite sides of the light case;

an illuminating assembly mounted inside the light case, pivotably connected to the first side segment and the second side segment of the light case, and having a base having two pivoting segments respectively located on two opposite ends of the base and respectively pivotably connected to the first side segment and the second side segment of the light case; and at least one lighting unit mounted on the base; and an adjusting assembly mounted on the first side segment of the light case, connected to the base, extending outside the light case, and adapted to tilt the illuminating assembly;

wherein the first side segment of the light case has a through hole;

wherein the adjusting assembly has a driving unit mounted through the through hole of the first side segment of the light case, and connected to the base; and a water blocking gasket mounted around the driving unit and clamped between the driving unit and an edge of the through hole.

2. The light as claimed in claim 1, wherein the base of the illuminating assembly has a circuit board; the at least one lighting unit mounted on the circuit board;

a heat sink mounted on a bottom surface of the circuit board; and a side panel securely mounted on an end of the circuit board; one of the two pivoting segments mounted on the side panel, and the driving unit of the adjusting assembly connected to the side panel.

3. The light as claimed in claim 2, wherein the driving unit of the adjusting assembly has an outer driving sheet located outside the light case and corresponding in position to the first side segment of the light case; and a shaft mounted through the through hole of the first side segment of the light case; two ends of the shaft respectively mounted on the outer driving sheet and the side panel of the base of the illuminating assembly; the shaft and an axis connecting the pivoting segment and the first side segment being coaxial;

the water blocking gasket is mounted around the shaft and is clamped between the edge of the through hole and the shaft.

4. The light as claimed in claim 2, wherein the side panel of the base of the illuminating assembly further has an elongated hole;

the driving unit of the adjusting assembly has an outer driving sheet located outside the light case and corresponding in position to the first side segment of the light case;

an inner transmission sheet located inside the light case, located between the side panel and the first side segment of the light case, and having a linkage protrusion protruding into the elongated hole of the side panel, and a shaft mounted through the through hole of the first side segment of the light case; two ends of the shaft respectively mounted securely on the outer driving sheet and the inner transmission sheet; the shaft and an axis connecting the pivoting segment and the first side segment being non-coaxial;

the water blocking gasket is mounted around the shaft and is clamped between the edge of the through hole and the shaft.

5. The light as claimed in claim 4, wherein the first side segment further has an anti-slip arced surface; a center of the anti-slip arced surface being coaxial with a center of the through hole of the first side segment;

an end of the outer driving sheet of the driving unit of the adjusting assembly is mounted securely on the shaft, and the other end of the outer driving sheet corresponds in position to the anti-slip arced surface of the first side segment of the light case;

the adjusting assembly further has a stop screw mounted through the outer driving sheet of the driving unit, threaded with the outer driving sheet, and selectively abutting the anti-slip arced surface of the first side segment of the light case.

6. The light as claimed in claim 4, wherein the adjusting assembly further has a worm gear securely mounted around the shaft of the driving unit and located outside the light case; and a worm screw rotatably mounted on the first side segment of the light case and engaging with the worm gear.

7. The light as claimed in claim 5, wherein the adjusting assembly further has a worm gear securely mounted around the shaft of the driving unit and located outside the light case; and a worm screw rotatably mounted on the first side segment of the light case and engaging with the worm gear.

8. The light as claimed in claim 7 further comprising at least one bracket mounted securely on a back segment of the light case.

9. The light as claimed in claim 8, wherein the first side segment and the second side segment are two detachable side covers.

10. The light as claimed in claim 1 further comprising at least one bracket mounted securely on a back segment of the light case.

11. The light as claimed in claim 1, wherein the first side segment and the second side segment are two detachable side covers.

* * * * *